United States Patent [19]

French

[11] 4,415,135

[45] Nov. 15, 1983

[54] SUPPORT DEVICES FOR SWIVEL CHAIRS

[75] Inventor: John A. W. French, Milton Keynes, England

[73] Assignee: WIPAC Group Sales Limited, Buckingham, England

[21] Appl. No.: 360,677

[22] Filed: Mar. 22, 1982

[30] Foreign Application Priority Data

Mar. 24, 1981 [GB] United Kingdom ..... 8109104
Jun. 30, 1981 [GB] United Kingdom ..... 8120162

[51] Int. Cl.[3] ..... F16M 11/00

[52] U.S. Cl. ..... 248/161; 248/162.1; 267/131

[58] Field of Search ..... 248/161, 162.1, 565; 267/64.12, 131, 132, 133; 137/493, 455

[56] References Cited

U.S. PATENT DOCUMENTS 3,199,636 8/1965 Carbon ..... 137/493 X
3,381,926 5/1968 Fritz et al. ..... 248/404
3,711,054 1/1973 Bauer ..... 248/161 X
4,245,826 1/1981 Wirges ..... 267/131

FOREIGN PATENT DOCUMENTS 2350075 5/1976 France .
1139561 2/1966 United Kingdom .
1173916 11/1966 United Kingdom .
1281624 7/1972 United Kingdom ..... 248/565

*Primary Examiner*—James T. McCall
*Assistant Examiner*—David L. Talbott
*Attorney, Agent, or Firm*—Leydig, Voit, Osann, Mayer & Holt, Ltd.

[57] ABSTRACT

A device for supporting a chair at a selected height, comprising a hydraulic cylinder operative to support the chair, the cylinder being contractable to lower the chair under the weight of the chair occupant and being subject to a spring bias which extends the cylinder to raise the chair when unoccupied. The cylinder comprises two fluid-filled chambers separated by a valve. The fluid flows between the chambers via the open valve during expansion and contraction of the cylinder, and the valve when closed blocks the fluid flow whereby to hydraulically lock the cylinder. The hydraulic fluid is preferably a grease.

9 Claims, 2 Drawing Figures

SUPPORT DEVICES FOR SWIVEL CHAIRS

BACKGROUND OF THE INVENTION

1. Field of the Invention

The present invention relates to a support device for a chair which enables the height of the chair to be adjusted for a typist or other swivel chair.

2. Description of the Prior Art

Adjustable support devices for swivel chairs conventionally comprise a screw lift assembly. In these devices the height of the chair is adjusted by rotating the chair about its swivel axis or by rotating another component. Support devices which enable the height of the chair to be adjusted without having to rotate the chair or another component, have been proposed in the form of a so-called gas spring consisting of a pneumatic cylinder which can support the chair at a selected height. The gas, usually nitrogen, is sealed within the cylinder but in practice it is almost impossible to achieve a perfect seal with the result that the cylinder does tend to leak, albeit at a very slow rate. Typically, the leakage is such that the cylinder will cease to function correctly after about two years use.

SUMMARY OF THE INVENTION

According to the present invention, there is provided a device for supporting a chair at a selected height, comprising a hydraulic cylinder operative to support the chair, the cylinder being contractable to lower the chair under the weight of the chair occupant and being subject to a spring bias which extends the cylinder to raise the chair when unoccupied, said cylinder comprising two fluid-filled chambers separated by valve means within the cylinder, manually-operated control means for selectively opening and closing the valve means, said fluid flowing between said chambers via the open valve means during expansion and contraction of the cylinder, and said valve means when closed blocking the fluid flow whereby to hydraulically lock the cylinder, the portions of the two chambers immediately adjacent the valve means being axially spaced such that there is a substantially direct axial flow between the chambers substantially without reversal of the flow direction.

Further according to the present invention, there is provided a device for supporting a chair at an adjustable height, said device comprising a hydraulic cylinder arranged, in use, with its axis vertical and including a body member and a piston member reciprocable within the body member, said body member containing two fluid-filled chambers separated by valve means, control means for selctively opening and closing the valve means to control fluid flow between the chambers, one of said chambers being defined between the body member, the piston member, and the valve means, and the other of said chambers being defined between the body member, the valve means and a spring-biased plunger reciprocable within the body member, one of said members being arranged to support the chair from the other of said members via the hydraulic fluid contained in said one chamber when the valve means is closed, and the said piston member when the device is loaded with the weight of the chair when occupied effecting displacement of fluid from said one chamber to said other chamber, via the valve means, when the valve means is opened whereby to lower the chair, said fluid flow into said other chamber displacing the plunger against its spring bias, said spring bias acting to displace the plunger to return fluid to the said one chamber when the valve means is opened and when the chair is unoccupied to thereby to raise the chair, the valve means being mounted in the interior of the body member directly between the two chambers, the portions of the two chambers immediately adjacent the valve means being axially spaced, and said valve means including a fluid passage extending substantially axially between the said portions of the two chambers.

BRIEF DESCRIPTION OF THE DRAWINGS

An embodiment of the invention will now be described, by way of example only, with reference to the accompanying drawing, in which.

DESCRIPTION OF THE PREFERRED EMBODIMENTS

Figure 1:
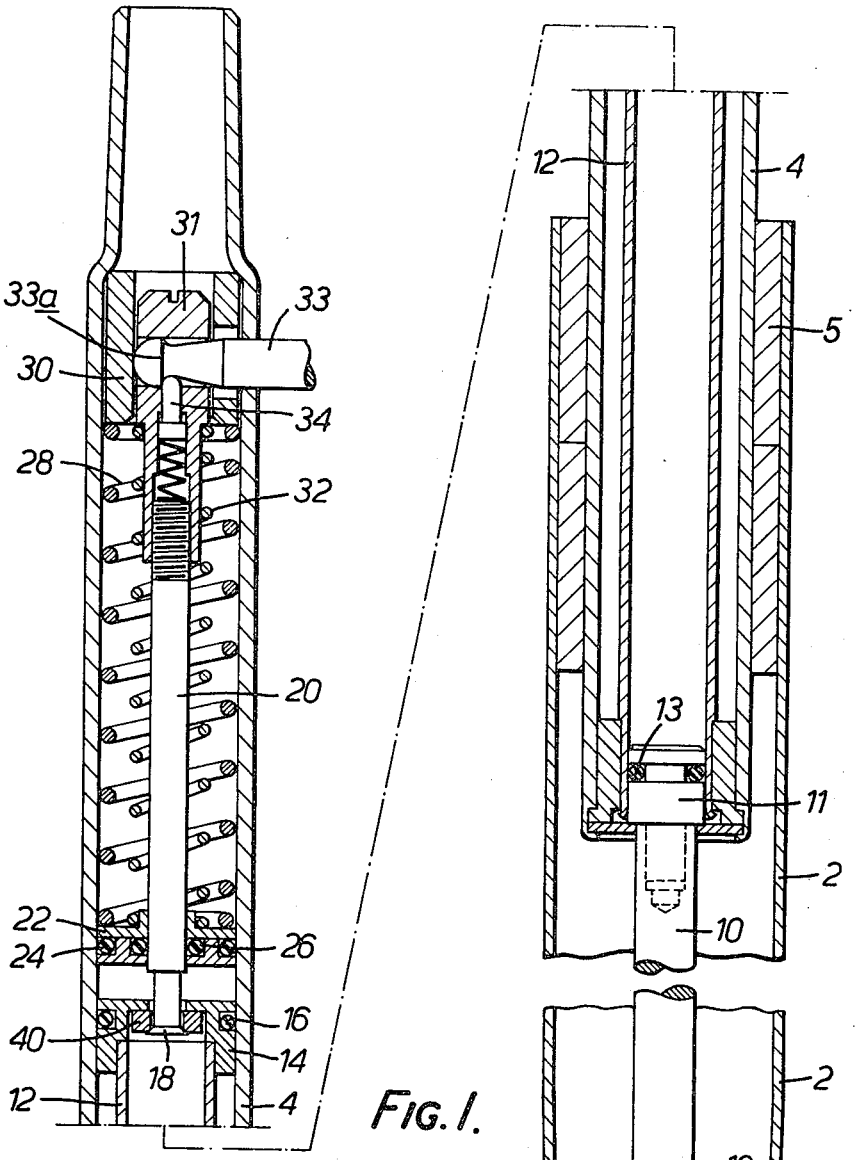
FIG. 1 is a schematic vertical section of an adjustable support device in accordance with the invention.
Figure 2:
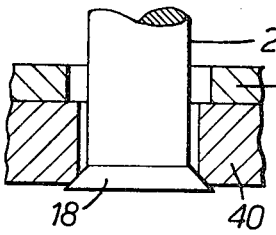
FIG. 2 is an enlarged fragmentary section showing a valve of the device.

The support device shown in FIGS. 1 and 2 is in the form of a telescopic support column comprising an outer tube 2 arranged to be fixed at its lower end in a suitable base (not shown), and an inner tube 4 mounted concentrically within the outer tube 2 by annular spacers 5 of nylon or other suitable low friction material, the inner tube 4 being arranged at its upper end to support the chair (not shown). The inner tube 4 is supported from the outer tube 2 by an assembly to be described herein which allows the height of the inner tube 4, and therefore of the chair, to be adjusted, and which allows the inner tube 4 and chair to be rotated about the longitudinal axis of the tube.

More particularly, the outer tube 2 has, at its lower end, a base plate 6 which supports, via a thrust ball bearing 8, a vertically extending shaft 10 which is received within the lower end portion of the inner tube 4 and is located on the axis of the inner tube 4. The shaft 10 carries at its upper end a piston 11 which is a sliding fit in a sleeve 12 firmly fixed within the lower end portion of the tube 4 and extending approximately half-way along the length of the tube 4. The piston 11 carries an O-ring 13 to provide a fluid-tight seal with the wall of the sleeve 12.

An annular valve body 14 of a valve is fixed within the tube 4 immediately above the upper end of the sleeve 12 by being secured to the sleeve 12, the valve body 14 being sealed with respect to the inner wall of the tube 4 by means of an O-ring 16. The valve body 14 co-operates with a valve member 18 which is attached to an elongate stem 20 extending upwardly.

Between the valve body 14 and the upper end of the tube 4, the valve stem 20 passes through the bore of an annular plunger 22 which is slidable relative to the tube 4 and valve stem 20, and is sealed relative to both these components by outer and inner O-rings 24 and 26 respectively. The interior of the inner tube 4 between the upper end of the piston 11 and the plunger 22 forms two hydraulic chambers which are filled with hydraulic fluid and which are separated by the valve body. The plunger 22 is biased downwardly into pressure contact with the body of the hydraulic fluid by a compression spring 28 interposed between the upper face of the plunger 22 and the underside of a sleeve 30 positioned within the upper end portion of the inner tube 4. The valve stem 20 is threadedly connected at its upper end to a piston 31 slidable axially within the sleeve 30 and is biased upwardly by a compression spring 32 interposed between a shoulder of the piston 31 and the plunger 22. This upward bias applied to the valve stem 20 moves the valve member 18 into a sealing position relative to the valve body 14. The valve stem can be moved downwardly against the bias of the spring 32 to open the valve by means of a lever 33 which extends through an aperture in the wall of the tube 4, and an aperture in the wall of the sleeve 30, into a transverse passage in the piston 31. The inner end of the lever 33 is shaped to define a shoulder 33*a* which can engage behind a spring-biased pin 34 mounted in the piston 31 to lock the inner end of the lever 33 in the piston 31. As will be apparent, the lever 33 lies adjacent the underside of the chair seat.

The detailed construction of the valve of the cylinder is shown in FIG. 2.

The internal bore of the valve body 14 is of constant diameter throughout its length, and the valve member 18, in the closed condition of the valve, seats against an internal frusto-conical surface of a washer 40. The washer 40 is floatingly mounted on the valve stem 20 with a small clearance existing between the internal bore of the washer 40 and the surface of the valve stem 20.

In the closed condition of the valve (as shown), the upper axial end face of the washer 40, which is a plane end face, seats against the plane underside of the valve body 14, and as described above, the valve member 18 seats against the washer 40.

In order to lower the height of the chair, the occupant of the chair, while sitting in the chair, will actuate the lever which depresses the valve stem 20 to open the valve. With the valve open, the tube 4 can move downwardly along the shaft 10 under the weight of the occupant. During this movement, hydraulic fluid is forced by the piston 11 from the lower chamber of the cylinder to the top chamber via the valve. The upward flow of fluid will tend to keep the washer 40 in contact with the underside of the valve body 14, so that the fluid will flow to the top chamber through the annular passage defined between the valve member 18 in its open position and the washer 40 and between the internal bore of the washer 40 and the valve stem 20; this passage is only of small cross-sectional size so that the fluid flow is relatively slow to provide controlled descent of the chair.

When the desired height is reached, the lever 33 controlling the valve stem 20 is released and the valve closes. The hydralic cylinder is thereby hydraulically locked and the weight of the occupant is supported by the body of hydraulic fluid locked within the bottom chamber of the cylinder. The chair can be swivelled by rotation of the tube 4 and shaft 10, as a unit, on the bearing 8.

The transfer of fluid from the bottom part of the cylinder to the top part during lowering of the chair height, will cause the plunger 22 to be raised within the tube 4 against the bias of the compression spring 28, thus further compressing this spring. When it is required to raise the chair from a lowered position, the lever 33 is actuated to open the valve when the chair is unoccupied. The spring 28 acts to raise the tube 4, and thus the chair, at a speed which is controlled by the rate of flow of fluid from the top chamber of the cylinder to the bottom. The fluid flowing from the top chamber of the cylinder will move the washer 40 downwards out of contact with the underside of the valve body 14, thereby providing a relatively large annular passage between the underside of the valve body and the washer through which the fluid will flow relatively quickly. When the desired height is reached, the user releases the lever to close the valve and thereby hydraulically lock the chair at the selected height.

The valve shown in FIG. 2 is relatively inexpensive to manufacture. In addition, the construction shown enables the cross-sectional area of the lower end face of the valve member 18 to be reduced which means that a smaller force is required to open the valve against the viscous resistance of the hydraulic fluid.

The hydraulic support device described is not subject to the disadvantage of fluid leakage which occurs with support devices which incorporate gas springs, and therefore has a significantly longer working life.

Advantageously, the hydraulic fluid used in the cylinder is a grease although an oil could be used. A suitable grease is "Shell Alvania EP1." Grease is preferred because, being viscous, it provides for greater control during descent of the chair under load, permits increased tolerances, and facilitates assembly of the device. The manner in which the device is assembled will now be described.

A sub-assembly is formed comprising; the sleeve 12, the valve body 14 attached to the upper end of the sleeve 12, the valve member 18 and valve stem 20, the piston 31, the plunger 22 and the compression spring 32 which acts between the piston 31 and the plunger 22 to bias the plunger 22 into contact with the valve body 14. The sleeve 12 is then filled with grease through its open end. As the grease is viscous it will not easily run-out from the cylinder after filling, even if the cylinder is inverted prior to being closed. The inner tube 4 is assembled with the sleeve 30 and the compression spring 28, and the sub-assembly consisting of the sleeve 12 filled with grease and the other components is inserted into the inner tube 4 through its open (lower) end, until the piston 31 at the upper end of the sub-assembly enters the bore of the sleeve 30.

When the piston 31 is within the sleeve 30, the inner end of the valve-actuating lever 33 can be inserted through the apertures in the walls of the inner tube 4 and sleeve 30 to be engaged with the piston 31, the inner end of the lever being retained in the transverse passage in the piston 31 by the spring biased pin 34 engaging behind the shoulder 33*a* at the end of the lever 33. With the lever 33 in position, the lever is operated to open the valve and the piston 11 is inserted into the open (lower) end of the sleeve 12 thus displacing some of the grease through the open valve into contact with the plunger 22 which is thereby moved away from the valve body 14. When the piston is in the end of the sleeve 12, the end of the sleeve is closed by inserting a washer over the shaft 10 and swaging the lower end of the inner tube 4 over the washer to retain the washer.

In the embodiment shown in the drawing, it will be seen that the valve body 14 seals an annular gap between the inner tube 4 and the sleeve 12 from the hydraulic fluid. In a modified embodiment (not shown) the valve body is not sealed to the inner tube, and therefore the annular gap between the tube 4 and the sleeve 12 communicates with the portion of the cylinder above the valve body. An annular plunger is mounted within the upper end of the annular gap and is biased upwardly by a compression spring lying within the annular gap.

This second plunger acts in conjunction with the plunger 22 and is moved downwardly against the bias of its compression upon displacement of the fluid into the top part of the cylinder during lowering of the seat. The plunger 22 is moved upwardly but by a lesser distance than in the first embodiment.

In the embodiment shown in the drawing, the bottom chamber of the hydraulic cylinder is defined by a sleeve 12 which is mounted within the tube 4 and which carries a valve body 14. This construction leads to several important advantages as will now be described.

The use of the sleeve 12 to define the bottom part of the cylinder means that the cross-sectional area of the bottom chamber of the cylinder is less than that of the top chamber of the cylinder which is defined by the tube itself; as shown the ratio of the cross-sectional areas of the top and bottom chambers of the cylinder is about 2.5:1. Thus the volume of fluid displaced from the bottom chamber to the top chamber per unit linear downwards displacement of the chair, will result in a smaller linear upwards displacement of the plunger 22. In a typical chair support device, the range of height adjustment would be 4 to 5 inches. If the top and bottom chambers were of the same cross-sectional area, the plunger would need to move upwards by the same amount and, of course, this would result in a corresponding contraction of the compression spring; in practice it would be difficult to provide a coil compression spring having the necessary characteristics to meet this requirement. In the embodiment shown, overall displacement of 5 inches in the chair, would result in only 2 inches of plunger displacement and this can readily be accommodated in the standard spring.

The smaller cylinder volume provided by using the sleeve to define the bottom chamber means that less hydraulic fluid is required, leading to reduced cost. The use of the sleeve 12 also provides a convenient way of mounting the valve body 14 within the tube 4 withhout having to weaken the tube in the zone of the cylinder.

The mounting of the valve within the cylinder in the manner shown facilitates sealing, and also facilitates the operation of the valve though a relatively simple mechanism actuated by a handle adjacent the underside of the chair seat.

It will be noted that the portions of the top and bottom chambers immediately adjacent the valve are axially spaced and are connected by a substantially axial passage when the valve is opened. The direct connection provided in this way without reversal of the flow direction during passage of the fluid from one chamber to the other enables the use of grease as the hydraulic fluid with the consequent advantages thereby obtained as discussed earlier; as will be apparent grease could not be used if a tortuous passage were provided between the two chamber parts.

Finally, operation of the device does not require the use of high internal pressures of the fluid. In contrast, gas springs are filled with gas at very high pressure and rely on this pressure for correct operation.

What is claimed is:

1. A device for supporting a chair at a selected height, comprising a hydraulic cylinder arranged to support the chair, the cylinder being contractable to lower the chair under the weight of the chair occupant, a spring member acting to extend the cylinder to raise the chair when unoccupied, means defining two fluid-filled chambers in the cylinder, valve means separating the chambers, and manually-operated control means for selectively opening and closing the valve means, said fluid flowing between said chambers via the open valve means during adjusting expansion and contraction of the cylinder, and said valve means when closed blocking the fluid flow whereby to hydraulically lock the cylinder against expansion and contraction, each chamber including a portion immediately adjacent the valve means, said portions being axially spaced such that there is a substantially direct axial flow between the chambers substantially without reversal of the flow direction, one of said chamber being of smaller cross-sectional area than the other of said chambers, a plunger reciprocable within the cylinder and defining a boundary of said other chamber, said spring member acting between the plunger and the cylinder to bias the plunger in a sense to reduce the volume of the said other chamber, and the fluid flowing from said one chamber to said other chamber during contraction of the cylinder and causing the plunger to be displaced against the bias of said deformable spring member.

2. A device for supporting a chair at an adjustable height, said device comprising a hydraulic cylinder arranged, in use, with its axis vertical and including a body member and a piston member reciprocable within the body member, means defining two fluid-filled chambers within the body member, valve means within the body member, said valve means separating the two chambers, manually-operable control means for selectively opening and closing the valve means to control fluid flow between the chambers, a plunger reciprocable within the body member, a deformable spring member biasing said plunger, one of said chambers being defined between the body member, the piston member, and the valve means, and the other of said chambers being defined between the body member, the valve means and the plunger, one of said members being arranged to support the chair from the other of said members via the hydraulic fluid contained in said one chamber when the valve means is closed, and the said piston member when the device is loaded with the weight of the chair when occupied effecting displacement of fluid from said one chamber to said other chamber, via the valve means, when the valve means is opened whereby to lower the chair, said fluid flow into said other chamber displacing the plunger against its spring bias, said spring bias acting to displace the plunger to return fluid to the said one chamber when the valve means is opened and when the chair is unoccupied to thereby to raise the chair, the valve means being mounted in the interior of the body member directly between the two chambers, and each chamber including a portion immediately adjacent the valve means, said portions being axially spaced, and said valve means including means defining a fluid passage extending substantially axially between the said portions of the two chambers, said one chamber having a cross-sectional area less than that of the said other chamber whereby the displacement of the plunger during lowering of the chair is less than the distance by which the chair is lowered.

3. A device according to claim 2, further comprising a fixed outer tube, said hydraulic cylinder being mounted within the fixed outer tube, bearing means supporting the piston member of the cylinder from the outer tube, said bearing means permitting swivelling of the cylinder about its axis, said body member of the cylinder being movable vertically and having an upper end arranged to support the chair, and sliding bearing means interposed between the outer tube and the body member to stabilize the body member relative to the outer tube.

4. A device according to claim 2, wherein the valve means includes means operative to permit relatively slow flow of fluid from said one chamber to said other chamber, and a faster flow of fluid from said other chamber to said one chamber.

5. A device according to claim 2, wherein the valve means comprises a valve body fixed relative to said body member of the cylinder, said valve body including said fluid passage, a valve stem extending downwardly through the said other chamber and the valve passage, a valve member carried by the stem and positioned within the said one chamber, said control means being operable to displace the valve stem axially, the valve member blocking flow through the passage when in a position adjacent the valve body, and the valve member permitting flow through the passage when in a position axially displaced further from the valve body.

6. A device according to claim 5, further comprising a floating flow-restrictor member responsive to fluid flow from the said one chamber towards the said other chamber to move into a position to restrict the flow rate of fluid through the passage, said restrictor member moving out of said position in response to fluid flow from said other chamber towards said one chamber whereby to permit an increased flow rate.

7. A device according to claim 6, wherein the restrictor member comprises a washer mounted floatingly on the valve stem, the valve member sealing against the washer and the washer sealing against the valve body when the valve means is closed.

8. A device according to claim 5, wherein the body member of the cylinder comprises inner and outer tubes fixed one to the other, said one chamber is defined by the inner tube, and said other chamber is defined by the outer tube.

9. A device according to claim 1 or claim 2, wherein the hydraulic fluid is grease.

* * * * *